United States Patent [19]

Muto et al.

[11] Patent Number: 4,695,007

[45] Date of Patent: Sep. 22, 1987

[54] APPARATUS FOR CONTINUOUSLY SUPPLYING SHEETS FROM SUPPLY ROLLS

[75] Inventors: Yoshiyuki Muto, Yonago; Tadao Etani, Tokyo; Satoru Aida, Sanjo; Shinya Kato, Tsubame, all of Japan

[73] Assignees: Sanjo Machine Works, Ltd., Manimakanbara; Japan Tobacco, Inc., Tokyo, both of Japan

[21] Appl. No.: 934,721

[22] Filed: Nov. 25, 1986

[30] Foreign Application Priority Data

Nov. 28, 1985 [JP] Japan ..... 60-268094

[51] Int. Cl.[4] ..... B65H 19/16

[52] U.S. Cl. ..... 242/58.4; 53/389; 156/502; 156/504

[58] Field of Search ..... 53/168, 389; 156/502, 156/504; 242/58.3, 58.4

[56] References Cited

U.S. PATENT DOCUMENTS

| | | | |
|---|---|---|---|
| 1,995,269 | 3/1935 | Tomlin | 242/58.4 |
| 4,466,577 | 8/1984 | Focke et al. | 242/58 |
| 4,543,152 | 9/1985 | Nozaka | 242/58.4 |

FOREIGN PATENT DOCUMENTS 56-124633 9/1981 Japan .

*Primary Examiner*—John Sipos

*Attorney, Agent, or Firm*—Pennie & Edmonds

[57] ABSTRACT

An apparatus of this invention includes first and second supply rolls of wrapping film sheets. The film sheet is fed from first supply roll to a wrapping machine. The distal end of the film sheet of the second supply roll is partially fixed by an adhesive tape. In this state, the film sheet cannot be fed from the second supply roll. The second supply roll can be rotated in the forward or reverse direction. The apparatus also includes a knife for cutting the adhesive tape of the second supply roll. When the remaining length of the film sheet fed from the first supply roll becomes short, the knife is brought into contact with the outer surface of the second supply roll. By utilizing the rotation of the roll, the knife is inserted under the distal end of the film sheet of the second supply roll. Thereafter, the knife is moved along the outer surface of the second supply roll in the axial direction thereof, thereby cutting the adhesive tape of the second supply roll. The apparatus also includes a belt conveyor for feeding the film sheet fed from the second supply roll to the feed path of the film sheet fed from the first supply roll.

6 Claims, 17 Drawing Figures

APPARATUS FOR CONTINUOUSLY SUPPLYING SHEETS FROM SUPPLY ROLLS

BACKGROUND OF THE INVENTION

The present invention relates to an apparatus for continuously supplying sheets from supply rolls, suitably used to supply a wrapping film sheet to, for example, a wrapping machine. The film sheet is normally available in a wound form, i.e., in the form of supply roll. A film sheet supplied from a supply roll is supplied to a wrapping machine. The length of the film sheet supplied from each supply roll is definite. If the supply roll becomes empty, the empty roll must be replaced with a full one. In order to perform roll replacement, an apparatus disclosed in Japanese Utility Model Disclosure (Kokai) No. 56-124633 is known.

This prior-art apparatus has a pair of supply rolls. While one roll is in use, i.e., while the film sheet is supplied from this supply roll, the other supply roll is held in a waiting state. Particularly, a predetermined length of the film sheet is fed in advance from the waiting supply roll, and the distal end of this film sheet is guided to a connection position near the supply path of the film sheet currently supplied. Since the waiting supply roll is provided in this apparatus, the distal end of the film sheet from the waiting supply roll is connected to the film sheet of the supply roll in use when the remaining length of the film sheet in use is less than a predetermined value. Thereafter, the film sheet from the supply roll in use is cut between the supply roll of its own and the connection position. The film sheet from the waiting supply roll can then be fed to the wrapping machine instead of the film sheet from the roll in use. According to the apparatus described above, feeding of the film sheet to the wrapping machine can be automatically replaced from one supply roll to the other supply roll.

When the waiting supply roll is loaded in the apparatus for continuously supplying sheets, the distal end of this film sheet is normally adhered to the outer surface of the supply roll by an adhesive tape. In the conventional apparatus, the adhesive tape must be manually removed from the waiting supply roll in order to guide the distal end of the film sheet to the connection position.

Demand has thus arisen for automatic removal of the adhesive tape from the supply roll. In order to satisfy this demand, various proposals have been made. However, no conventional apparatuses satisfy this requirement in practice.

SUMMARY OF THE INVENTION

It is an object of the present invention to provide an apparatus for continuously supplying sheets from supply rolls, wherein when the remaining length of a sheet fed from one supply roll in use becomes less than a predetermined value, the distal end of a sheet fed from a full waiting supply roll can be automatically adhered to the sheet fed from one supply roll.

In order to achieve the above object of the present invention, there is provided an apparatus for continuously supplying sheets from supply rolls, comprising:

a rotary disc vertically disposed such that a central axis thereof extends in a horizontal direction, the rotary disc being rotatable about the central axis;

a first supply roll mounted at a peripheral portion of the rotary disc and including a roll of sheet material, the first supply roll having a first axis parallel to the central axis of the rotary disc, the first supply roll being rotatable about the first axis;

means for feeding the sheet from the first supply roll, the feeding means having a sheet feeding path;

a second supply roll mounted at a peripheral portion of the rotary disc and including a roll of sheet material, the second supply roll having a second axis parallel to the central axis of the rotary disc and being rotatable about the second axis, the second supply roll being provided with an adhesive tape for partially fixing a distal end of the sheet to an outer surface of the second supply roll;

a cutting/feeding device, disposed near the rotary disc, for cutting the adhesive tape of the second supply roll and feeding the sheet therefrom, the cutting/feeding device including driving means for reversibly rotating the second supply roll, knife means provided with a knife to come into contact with or to be separated from the outer surface of the second supply roll, and actuating means for moving the knife along a direction parallel to the second axis of the second supply roll when the knife of the knife means is inserted under the distal end of the sheet of the second supply roll, the knife being adapted to be inserted under a portion excluding a region of the distal end of the sheet of the second supply roll upon driving of the second supply roll by the driving means, the region being fixed to the outer surface of the second supply roll be means of the adhesive tape, whereby the adhesive tape of the second supply roll is cut upon cooperation of the knife and the actuating means and, thereafter, the sheet of the second supply roll is fed therefrom upon rotation of the second supply roll by the driving means;

guiding means for guiding the sheet fed from the second supply roll, and hence the distal end thereof, to a predetermined connection position in the feed path of the feeding means;

adhering means for adhering the sheet from the first supply roll to the distal end of the sheet from the second supply roll at the connection position; and cutting means, disposed in the feed path between the connection position and the first supply roll, for cutting the sheet fed from the first supply roll.

Since the apparatus of the present invention is provided with the cutting/feeding device, the adhesive tape of the second supply roll can be cut by the knife means of the cutting/feeding device. The cutting/feeding device does not only cut the adhesive tape of the second supply roll, but also causes the driving means to rotate the second supply roll after the adhesive tape is cut, thereby feeding the sheet from the second supply roll. The sheet fed from the second supply roll is guided by the guiding means, so that the distal end thereof is fed to the connection position of the feed path of the sheet fed from the first supply roll. The sheet of the first supply roll can be adhered to the distal end of the sheet from the second supply roll at the connection position. In the apparatus according to the present invention, therefore, since the sheet of the first supply roll can be connected to the sheet of the waiting second supply roll when the remaining length of the sheet from the first supply roll in use is short, sheet feeding can be automatically switched from the first supply roll to the second supply roll.

DETAILED DESCRIPTION OF THE PREFERRED EMBODIMENTS

Figure 1:
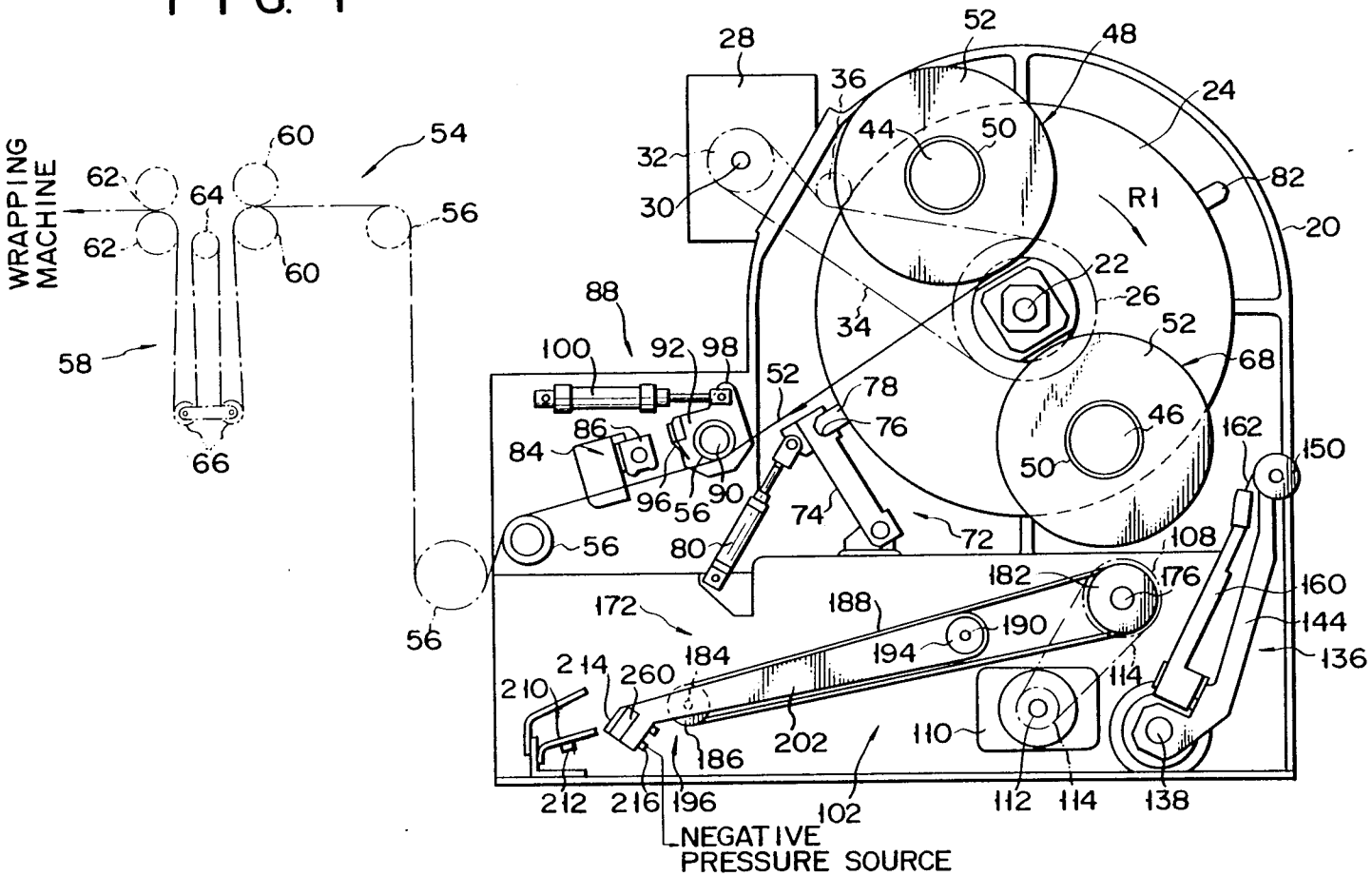
FIG. 1 is a schematic front view of an apparatus according to an embodiment of the present invention.

An apparatus for supplying a wrapping film, which is suitably used in a wrapping system for cigarette packages, is illustrated in FIG. 1. This supply apparatus comprises vertical base 20. Central shaft 22 is rotatably mounted on base 20. Shaft 22 extends horizontally from base 20, and the extended end of shaft 22 serves as a free end. Rotary disc 24 is mounted on the free end of shaft 22. Sprocket 26 is mounted at the shaft 22 portion near base 20. This sprocket 26 is illustrated in detail in FIG. 2. Electric motor 28 is arranged on base 20 for sprocket 26, as shown in FIG. 1. Sprocket 32 is mounted on output shaft 30 of motor 28, and endless chain 34 is arranged between sprocket 32 and sprocket 26 on shaft 22. As schematically illustrated in FIG. 1, tension sprocket 36 is mounted on base 20 to apply a predetermined tension force to chain 34. Therefore, chain 34 is driven by motor 28 and then disc 24 can be rotated in the direction of arrow R1 in FIG. 1.

Figure 2:
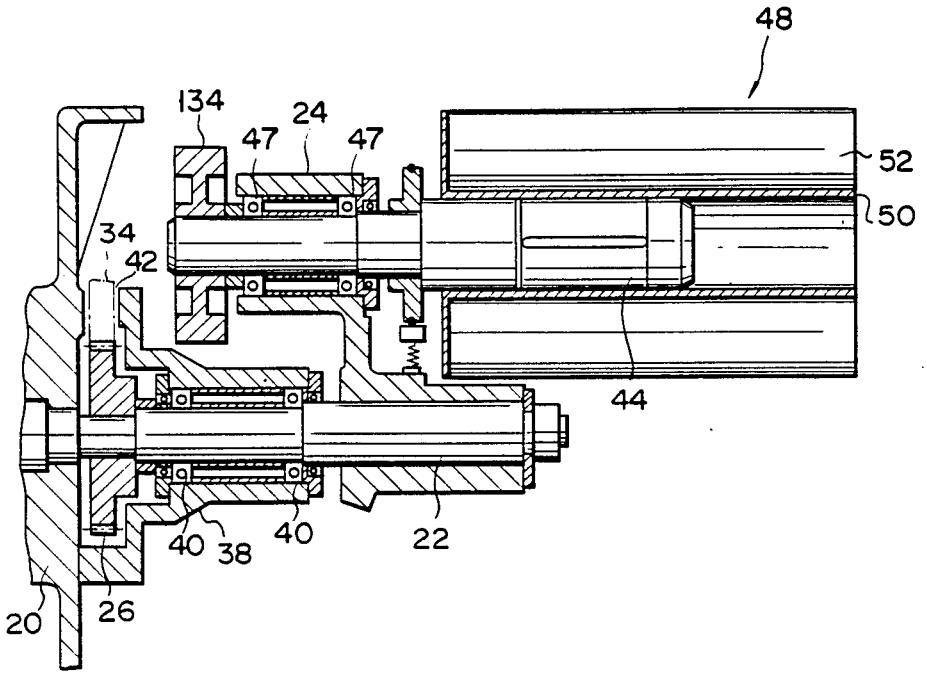
FIG. 2 is a partial sectional view of the apparatus in FIG. 1.

Referring to FIG. 2, bearing housing 38 is fixed on base 20 to support shaft 22. Housing 38 has a hollow cylindrical shape so as to accommodate sprocket 26 therein. A pair of roller bearings 40 are mounted in housing 38 to rotatably support shaft 22. Opening 42 is formed in the wall surface of housing 38 to allow looping of chain 34 between sprockets 26 and 32.

First and second shafts 44 and 46 are disposed in the peripheral portion of disc 24 to be symmetrical about shaft 22. The mounting structure of shaft 44 with respect to disc 24 is the same as that of shaft 46, and only the mounting structure of shaft 44 with respect to disc 24 will be described with reference to FIG. 2. Shaft 44 extends through disc 24 and is rotatably supported on disc 24 through roller bearings 47.

Supply roll 48 is detachably mounted on one end of shaft 44 which extends from disc 24 away from base 20. Roll 48 comprises bobbin 50 and wrapping film sheet 52 wound therearound. In this embodiment, sheet 52 is made of a thermoplastic resin such as cellophane or polypropylene. However, sheet 52 may be made of paper.

Film sheet 52 of supply roll 48 can be fed therefrom by feeding mechanism 54 schematically illustrated in FIG. 1. Mechanism 54 includes a plurality of guide rollers 56 defining a feed path of sheet 52 from roll 48. Only some of guide rollers 56 are illustated in FIG. 1. The feed path of sheet 52 is extend to a wrapping machine (not shown) for a cigarette packases. Dancer roller device 58 is arranged midway along the feed path. Device 58 comprises a pair of feed rollers 60 arranged to sandwith the feed path of sheet 52 therebetween, another pair of feed rollers 62 having the same arrangement as that of rollers 60 and separated therefrom by a predetermined distance along the direction of flow of sheet 52, direction reversal roller 64 disposed between rollers 60 and 62, and a pair of dancer rollers 66 arranged below roller 64 and rotatably supported by a pair of link arms. In dancer roller device 58, sheet 52 is guided through rollers 60, one dancer roller 66, direction reversal roller 64, the other dancer roller 66, and feed rollers 62. Therefore, sheet 52 can be stored between rollers 60 and 62, as shown in FIG. 1. This indicates that sheet 52 can be intermittently supplied to a wrapping machine (not shown) for every predetermined length by intermittently driving the feed rollers 62, even if the feed rollers 60 are continuously driven.

Figure 3:
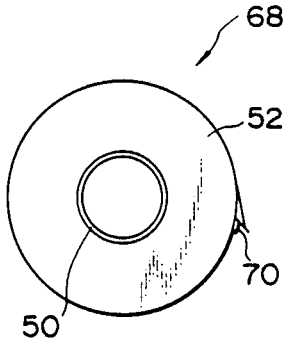
FIG. 3 is a front view of a supply roll used in the apparatus in FIG. 1.
Figure 4:
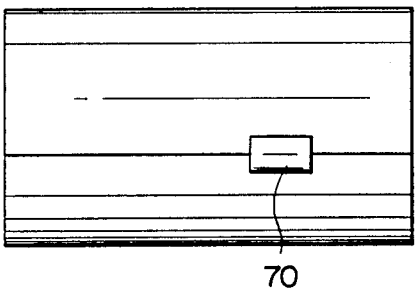
FIG. 4 is a side view of the supply roll in FIG. 3.

Supply roll 68 is mounted on second shaft 46 in the same manner as roll 48 on first shaft 44. Since roll 68 has the same construction as that of roll 48, the same reference numerals as in roll 48 denote the same parts in roll 68, and a detailed description will be omitted. However, roll 68 is different from roll 48 in use in that part of the distal end of sheet 52 of roll 68 is partially fixed to the outer surface of roll 68 by an adhesive tape 70, as shown in FIGS. 3 and 4. In other words, roll 68 is a waiting supply roll, with respect to roll 48 in use. In this embodiment, tape 70 is made of an aluminum label, one surface of which is defined as an adhesive surface. Tape 70 is deviated from the center of roll 68 by a predetermined distance along the direction of width, as is apparent from FIG. 4. Tape 70 is deviated in this manner, the mounting posture of roll 68 with relative to the shaft 46 is easily determined by the position of tape 70.

In a state where film sheet 52 is fed from supply roll 48, roll 68 is located below roll 48, as shown in FIG. 1. The positional relationship between rolls 48 and 68 is determined by rotation of disc 24. When disc 24 and rolls 48 and 68 are held in the state of FIG. 1, their rotation is prevented by positioning/stopper device 72.

Positioning/stopper device 72 comprises stopper arm 74. The proximal end of arm 74 is rotatably supported on base 20, so that arm 74 can be rotated to come close to or to be separated from the periphery of disc 24. Recess 76 opposite to the periphery of disc 24 is formed on the upper end of arm 74. Ratchet 78 extends from the periphery of disc 24 and is adapted to engage with recess 76. Air cylinder 80 is disposed between base 20 and the upper end of stopper arm 74. Cylinder 80 maintains engagement between recess 76 of stopper arm 74 and ratchet 78 of disc 22, thereby positioning rolls 48 and 68 and preventing disc 24 from rotation. Another ratchet 82 extends from the circumferential surface of disc 24 at a position symmetrical with the position of ratchet 78 about shaft 22.

In the feed path of film sheet 52 from supply roll 48, adhesion device 84 is arranged between guide rollers 56 of feed mechanism 54, as indicated by the solid line in FIG. 1. Device 84 comprises heater block 86 made of metal. This block 86 extends along a direction perpendicular to the feed path of film sheet 52 and is located slightly above the feed path. An electric heater (not shown) is embedded in block 86. Upon energization of the electric heater, block 86 can be heated to a predetermined temperature. The operation of heater device 84 will be described later on.

Cutter device 88 is arranged in the feed path of film sheet 52 between heater device 84 and supply roll 48 for cutting sheet 52. In this embodiment, device 88 comprises plate 92 rotatably mounted on shaft 90 of guide roller 56 near to supply roll 48. Plate 92 has cross bar 94 located above the feed path of sheet 52 and extending so as to cross sheet 52. Bar 94 has cutter 96. This cutter 96 is located immediately above sheet 52 running along the feed path and has a blade extending so as to cross this film sheet. In this embodiment, the blade of cutter 96 has a saw-toothed shape (not shown). Projection 98 extends upward from plate 92. Projection 98 is coupled to the piston rod of air cylinder 100 through a pin. The cylinder portion of cylinder 100 is fixed to base 20. If the piston rod of cylinder 100 is withdrawn from the state of FIG. 1 to rotate plate 92 counterclockwise by a predetermined angle, sheet 52 fed from supply roll 48 can be cut by cutter 96.

Figure 8:
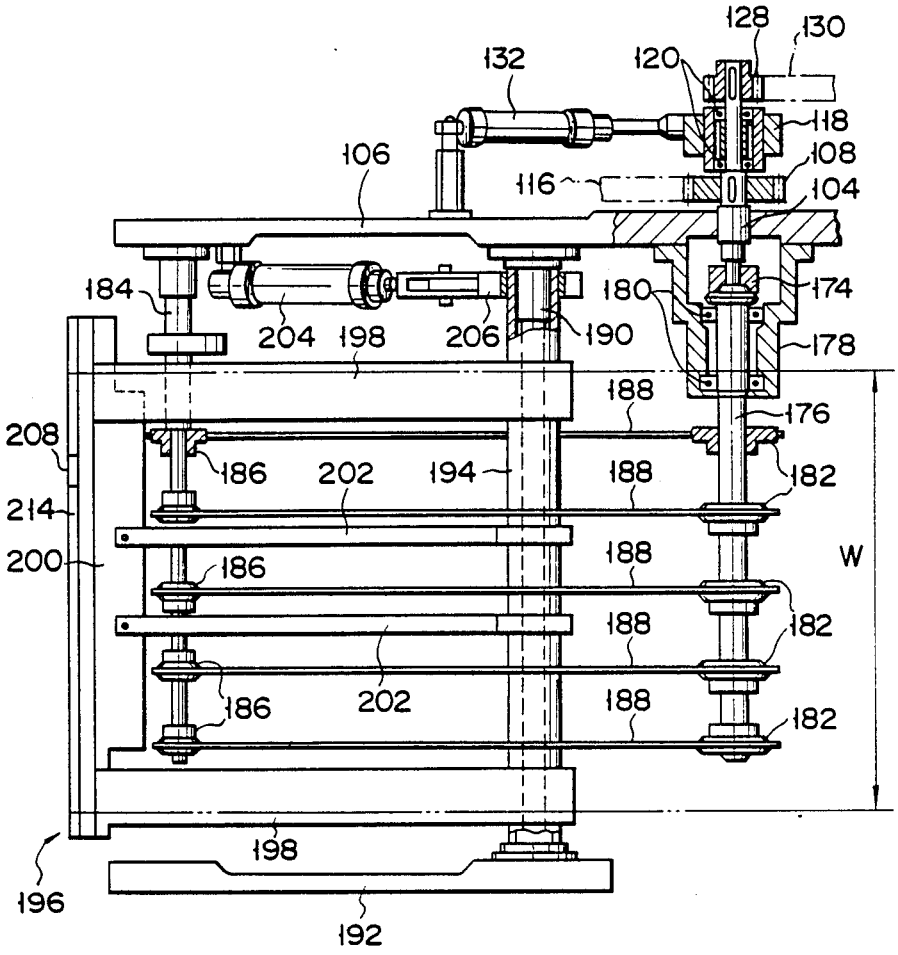
FIG. 8 is a plan view showing a film sheet guide mechanism in the apparatus of FIG. 1.

Cutting/feeding device 102 is arranged below rotary disc 24. Device 102 includes drive mechanism 103 for rotating roll 68. In the state shown in FIG. 1, drive mechanism 103 is located below roll 68 and has shaft 104 extending to be parallel to the axis of roll 68. Shaft 104 rotatably extends through support plate 106 (plate 106 is not illustrated in FIG. 1) extending to be parallel to disc 24, as shown in FIG. 8. Sprocket 108 is mounted at one end of shaft 104 which extends from plate 106 toward base 20. Electric motor 110 is arranged between base 20 and plate 106. Sprocket 114 is mounted on output shaft 112 of motor 110. Chain 116 is arranged between sprockets 108 and 114. Thus, shaft 104 can be rotated by a driving force of motor 110. Further, motor 110 is a reversible motor, and thus shaft 104 can be rotated in the forward/reverse direction.

Figure 5:
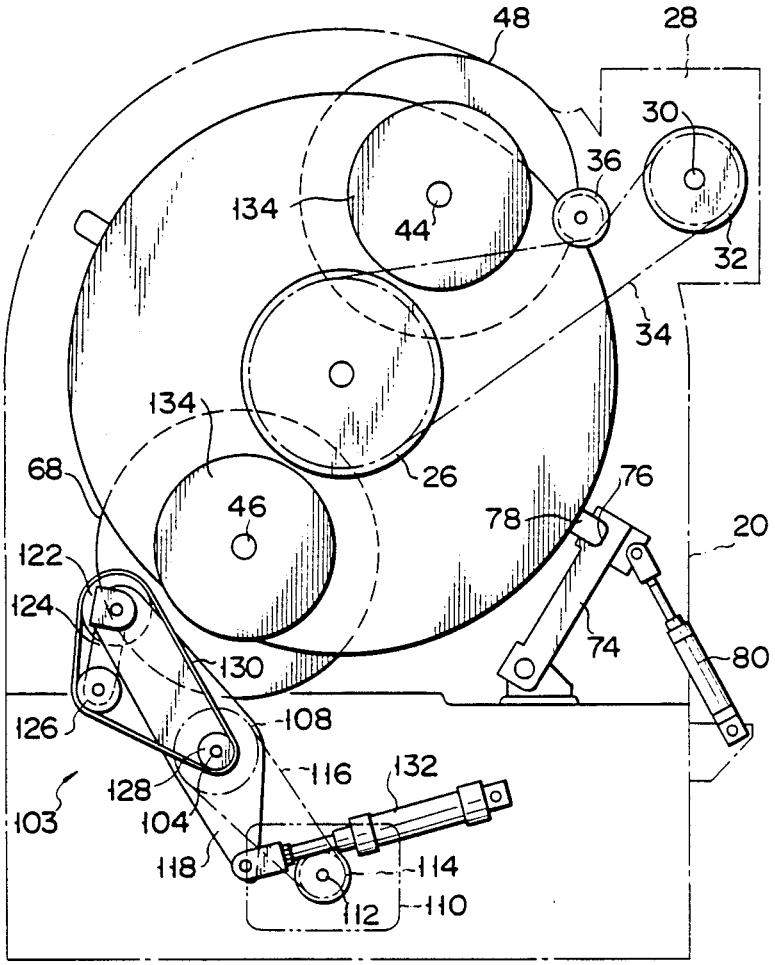
FIG. 5 is a schematic rear view of the apparatus in FIG. 1.

As is apparent from FIGS. 5 and 8, arm 118 is mounted on shaft 104 through bearings 120 at a position near base 20 with respect to sprocket 108. Arm 118 extends upward on the one hand and downward on the other hand. Driven pulley 122 is rotatably mounted at the upper end portion of arm 118. Arm 124 extends downward from the upper end portion of arm 118. Driven pulley 126 is rotatably mounted on the lower end portion of arm 124. Driving pulley 128 for pulleys 122 and 126 is mounted on a position on shaft 104 closer to base 20 than arm 118 is. Driving belt 130 is arranged between pulleys 128 and 122 through pulley 126. With the above construction, if shaft 104 is rotated by motor 110, belt 130 starts running.

The piston rod of air cylinder 132 is coupled to the lower end of arm 118. Cylinder 132 is supported by plate 106, as shown in FIG. 8. Therefore, if cylinder 132 is driven to cause its rod to extend, arm 118 is rotated about shaft 104.

Wheels 134 are mounted on ends of first and second shafts 44 and 46 of supply rolls 48 and 68. These ends extend from rotary disc 24 toward base 20 as shown in FIG. 2. In the state shown in FIG. 5, only wheel 134 of roll 68 is located in a position where the wheel 134 can be in rolling contact with driving belt 130. When air cylinder 132 is driven to cause its piston rod to extend from the state of FIG. 5 and to rotate arm 118 clockwise by a predetermined angle, pulley 122 is brought into rolling contact with wheel 134 of roll 68 through belt 130. At the same time, upon running of belt 130, wheel 134 is rotated together with roll 68.

Figure 7:
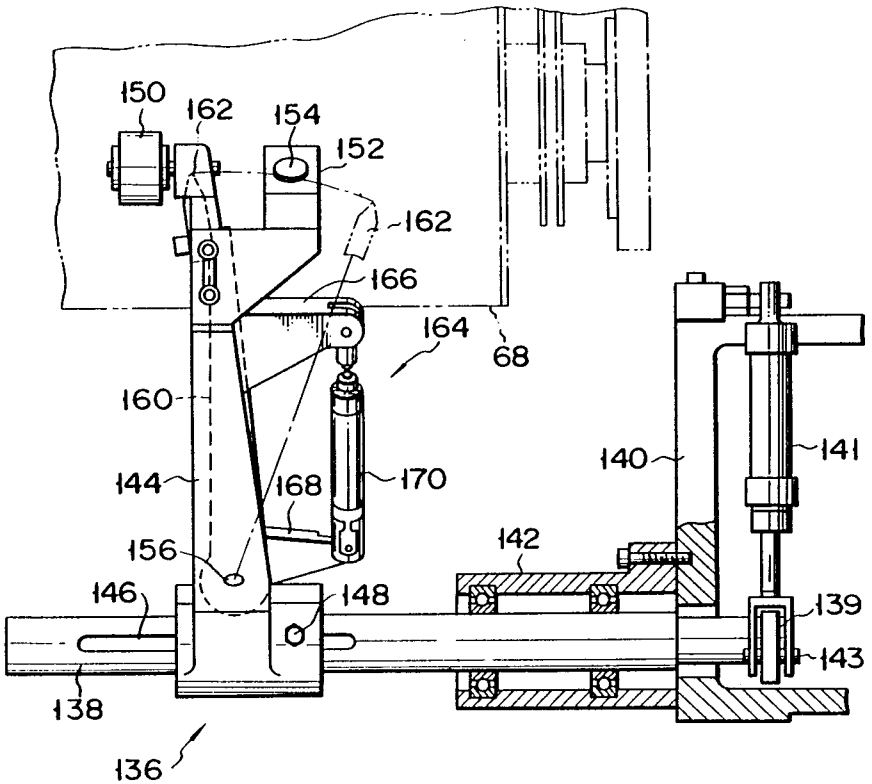
FIG. 7 is a partially cutaway side view of the knife mechanism in FIG. 6.
Figure 6:
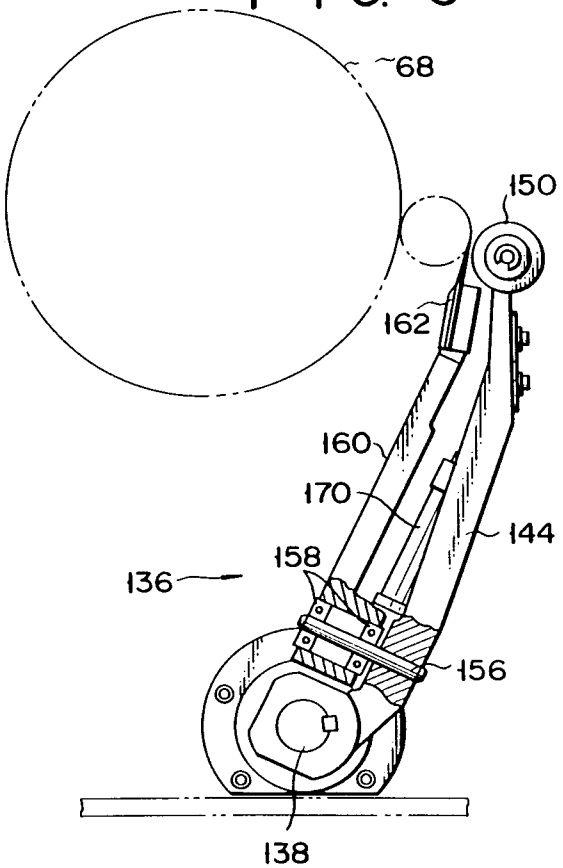
FIG. 6 is a partially cutaway front view of a knife mechanism in the apparatus of FIG. 1.

Cutting/feeding device 102 comprises knife mechanism 136. As shown in FIG. 1, mechanism 136 is located at the lower right side of supply roll 68. The detailed construction of mechanism 136 is best shown in FIGS. 6 and 7. Mechanism 136 has shaft 138. Shaft 138 extends to be parallel to the axis of roll 68. One end of shaft 138 is rotatably supported by support 140 through bearing unit 142. Support 140 is mounted on base 20. One end of shaft 138 extends from support 140, and radial arm 139 is mounted thereon to extend outward. The piston rod of air cylinder 141 is coupled to arm 139 through pin 143. Cylinder 141 is supported by support 140. Withdrawal/extension of the piston rod of cylinder 141 allows rotation of shaft 138.

Swing arm 144 is mounted on the other end portion of shaft 138. Arm 144 can be moved along groove 146 in the axial direction of shaft 138. Groove 146 is formed in the outer surface of shaft 138. Arm 144 can be fixed by bolt 148 at a predetermined position along the axial direction of shaft 138.

Arm 144 extends upward toward roll 68. Rubber roller 150 is rotatably mounted at the upper end of arm 144. Arm 152 is provided with the upper end portion of arm 144 and extends to be parallel thereto. Sensor 154 is arranged at the distal end of arm 152 to detect the distal end of film sheet 52 of supply roll 68. In this embodiment, sensor 154 comprises an inductive transducer for detecting the presence of metal tape 70 of supply roll 68.

Rod 156 extends through the proximal portion of swing arm 144 toward supply roll 68 in a direction perpendicular to shaft 138. Knife arm 160 is rotatably mounted on rod 156 through bearings 158. Arm 160 extends toward roll 68 in the same manner as arm 144. Knife 162 is fixed on the upper end of arm 160. Knife 162 comprises a spring plate tapered toward its tip and having elasticity. As is apparent from FIG. 7, knife 162 is normally located between rubber roller 150 and sensor 154 when viewed along the axial direction of roll 68.

Knife arm 160 is rotated about rod 156 by actuation mechanism 164. In this embodiment, mechanism 164 comprises bracket 166 extending from the side of arm 144. Bracket 166 is located above rod 156. Arm portion 168 is integrally formed with the proximal portion of knife arm 160 and extends in the same direction as that of bracket 166. Air cylinder 170 is arranged between arm portion 168 and bracket 166 to couple them. The construction of mechanism 164 allows rotational movement of knife arm 160 clockwise (FIG. 7) upon extension of the piston rod of air cylinder 170.

In addition to knife mechanism 136, guide device 172 is arranged below supply roll 68. Device 172 guides film sheet 52 from supply roll 68 toward the feed path of sheet 52 from roll 48. As shown in FIG. 8, guide device 172 comprises shaft 176 coaxially coupled to shaft 104 through one-way clutch 174. Shaft 176 is rotatably cantilevered on support pipe 178 through bearings 180. Pipe 178 is fixed on support plate 106. Shaft 176 extends from pipe 178 by a predetermined length. The extension length can be easily expected from width W of film sheet 52 to be fed from roll 68, as shown in FIG. 8.

One-way clutch 174 transmits a force from shaft 104 to shaft 176, and this force acts to rotate shaft 176 counterclockwise in FIG. 1. As described above, even if shaft 104 is rotated in the forward/reverse direction, shaft 176 is rotated in only one direction determined by one-way clutch 174.

For example, five driving pulleys 182 are equidistantly mounted on shaft 176 along its axial direction. On the other hand, shaft 184 is cantilevered on support plate 106 and extends to be parallel to shaft 176. As is apparent from FIG. 1, shaft 184 is located opposite knife mechanism 136 so as to define a predetermined distance between shafts 176 and 184. Driven pulleys 186 are equidistantly mounted on shaft 184 along its axial direction and respectively correspond to pulleys 182 on shaft 176. Endless belts 188 are arranged between corresponding driving and driven pulleys 182 and 186, respectively. Upper belt portions of belts 188 are located on a same plane. Pulleys 186 are located below pulleys 182, as is apparent from FIG. 1. The upper belt portions of belts 188 obliquely extend downward from corresponding pulleys 182.

Shaft 190 is disposed between shafts 176 and 184 and extends to be parallel to shafts 176 and 184. One end of shaft 190 is supported by support plate 106. The other end of shaft 190 extends over the free ends of shafts 176 and 184 and is supported by another support plate 192 located to be parallel to plate 106. Pipe member 194 is mounted on shaft 190 and is rotatable about shaft 190. Pipe member 194 extends between the upper and lower belt portions of belts 188, as is apparent from FIG. 1. Lifter 196 is mounted on pipe member 194. Lifter 196 comprises a pair of arms 198 located both outside of belts 188 and extending to be parallel thereto. The proximal end of each arm 198 is coupled to pipe member 194. The distal end of each arm 198 is coupled each other through cross plate 200 extending to be parallel to pipe member 194. The distance between the outer sides of arms 198 is set to be slightly larger than width W of film sheet 52 fed from supply roll 68. Lifter 196 further comprises a pair of auxiliary arms 202 located between driving belts 188 and adapted to couple pipe member 194 and cross plate 200. Therefore, lifter 196 can be pivoted about shaft 190 upon rotation of pipe member 194 regardless of the presence of driving belts 188. In other words, the distal end, i.e., cross plate 200, of lifter 196 is lifted upward from the state of FIG. 1. In the state of FIG. 1, belts 188 are positioned slightly upward from arms 198 and 202 of lifter 196.

Lifter 196 is pivoted by air cylinder 204 shown in FIG. 8. Arm portion 206 is provided at one end of pipe member 194 at the side of support plate 106. The piston rod of air cylinder 204 is coupled to arm portion 206. The cylinder portion of cylinder 204 is supported by support plate 106. Since cylinder 204 is coupled to pipe member 194, lifter 196 is pivoted upon withdrawal or extension of the piston rod of cylinder 204.

The length from the pivotal center, i.e., shaft 190, of lifter 196 to its distal end is set to be a length such that the distal end of lifter 196 sufficiently reaches the feed path of film sheet 52 fed from supply roll 48 when lifter 196 is pivoted upward. Sensor 208 is arranged at the distal end portion, i.e., cross plate 200, of lifter 196 to detect the distal end of sheet 52 fed from roll 68, as shown in FIG. 8. Sensor 208 comprises an inductive transducer in the same manner as sensor 154 in knife mechanism 136 and detects a part of metal tape 70 left at the distal end of film sheet 52 even after tape 70 is cut by knife mechanism 136.

Suction portion 214 for film sheet 52 is provided on cross plate 200. Sheet 52 can be attracted to suction portion 214 by drawing external air. Suction portion 214 is connected to a negative pressure source (not shown) through connection portion 216 shown in FIG. 1.

In the state shown in FIG. 1, reception portion 210 is disposed in front of the distal end of lifter 196 to receive the distal end of film sheet 52 fed from supply roll 68. Sensor 212 identical with sensor 208 is arranged in reception portion 210.

The operation of the apparatus of the above embodiment will be described with reference to FIGS. 9 to 16.

In the state of FIG. 1, film sheet 52 has already been fed from supply roll 48. However, the operation of this apparatus is started when the remaining length of sheet 52 in roll 48 is less than a predetermined length. The remaining length of sheet 52 of roll 48 can be detected as follows. A metal tape is adhered to the end portion of sheet 52 of roll 48 and is used for end detection. A sensor is arranged midway along the feed path near roll 48 to detect the tape. This sensor may be of the same type as described above.

Figure 9:
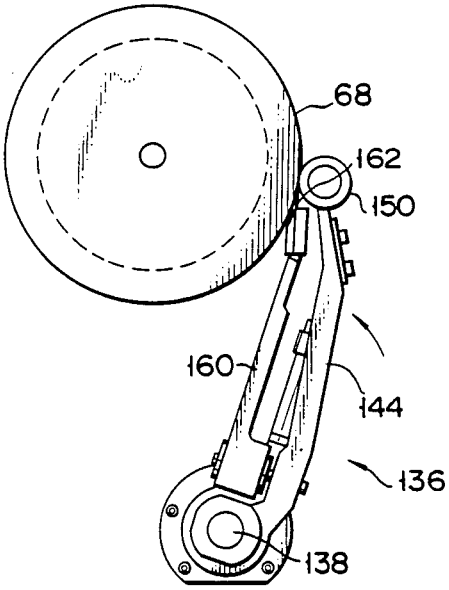
FIGS. 9 to 16 are views for explaining the operation of the apparatus in FIG. 1.
Figure 10:
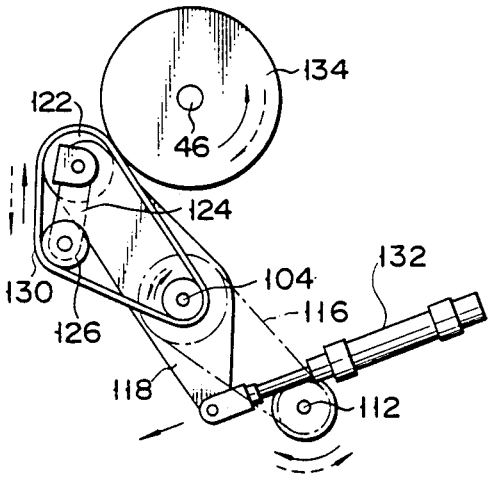

When the operation of this apparatus is started, shaft 138 in knife mechanism 136 is pivoted by air cylinder 141 shown in FIG. 7. Swing arm 144 is then pivoted toward supply roll 68, as shown in FIG. 9. Rubber roller 150 of arm 144 is brought into rolling contact with roll 68. As is apparent from FIG. 9, at the same time, knife 162 is brought into contact with roll 68. In this state, when electric motor 110 is driven in one direction, shaft 104 is rotated in a direction of an arrow shown as broken line in FIG. 10. As a result, driving belt 130 is driven in a direction of an arrow shown as a solid line. Thereafter, when the piston rod of air cylinder 132 is extended from the state of FIG. 1, arm 118 is pivoted, as shown in FIG. 10. Driving belt 130 is brought into contact with wheel 134. Wheel 134 is rotated in the direction of the broken line upon running of belt 130. In this manner, when wheel 134 is rotated, roll 68 is rotated in the direction of the broken line in FIG. 11. Roll 68 is rotated in the direction opposite to the direction of the tip of knife 162 contacting the outer surface of roll 68. In this case, the distal end of sheet 52 of roll 68 is still partially fixed by adhesive tape 70. When roll 68 is rotated and then the distal end, i.e., adhesive tape 70, of roll 68 passes below sensor 154 in knife mechanism 136, sensor 154 detects passing of tape 70 thereunder. When a predetermined delay time has elapsed upon detection of tape 70 by sensor 154, electric motor 110 is stopped. At the same time, belt 130 and wheel 134 are also stopped, and thus roll 68 is stopped. Thereafter, motor 110 is rotated in the reverse direction, and roll 68 is rotated in a direction of the solid line in FIG. 11 by a predetermined angle. As a result, the tip of knife 162 in knife mechanism 136 is inserted under the distal end of sheet 52 of roll 68, as shown in FIG. 12.

Figure 11:
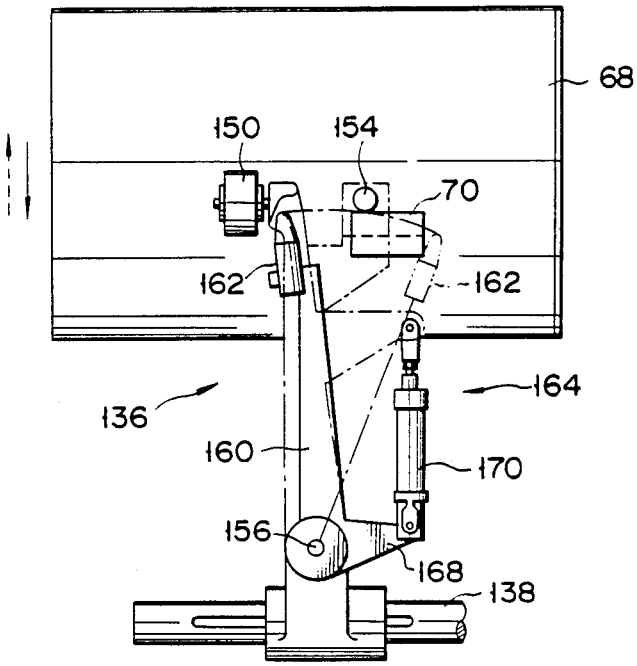
Figure 12:
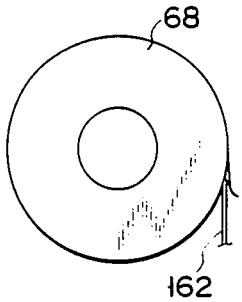

In this state, knife arm 160 is pivoted clockwise about rod 156 in FIG. 11 upon extension of the piston rod of air cylinder 170. Upon pivotal movement of arm 160, knife 162 is moved to cut tape 70. The distal end of sheet 52 is freely released from roll 68. As is apparent from FIG. 11, since the left portion (with respect to tape 70) of the distal end of sheet 52 is pressed by rubber roller 150 of knife mechanism 136, tape 70 can be properly cut by knife 162.

Figure 13:
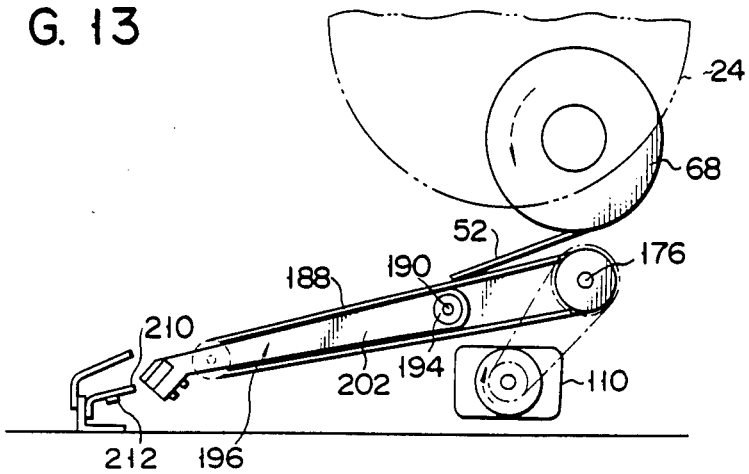

Thereafter, when electric motor 110 is driven in the forward direction again, supply roll 68 is rotated in a direction of the broken line of FIG. 13 by a predetermined angle. The distal end of sheet 52 of roll 68 is rotated counterclockwise in FIG. 13 and is separated from the outer surface of roll 68. As a result, the free distal end of sheet 52 is placed on belts 188 of guide device 172 located under roll 68, as shown in FIG. 13.

Figure 14:
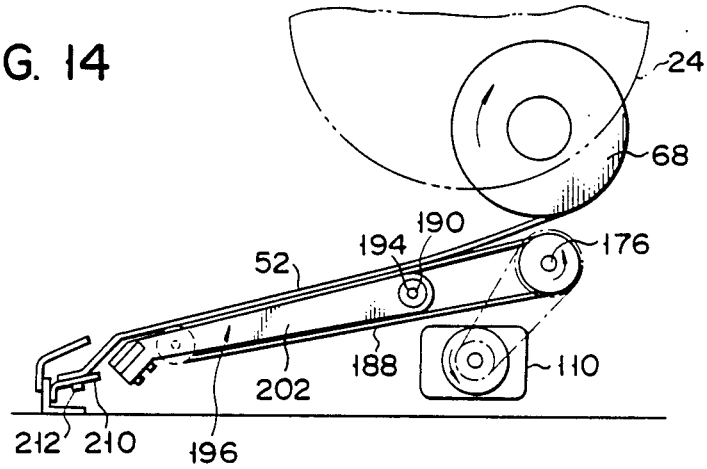

In this state, when motor 110 is driven in the reverse direction again and roll 68 is rotated in a direction of the solid line in FIG. 14, film sheet 52 is fed therefrom. At the same time, belts 188 in device 172 are driven counterclockwise in FIG. 14. More specifically, upon reverse rotation of motor 110, shaft 104 shown in FIG. 8 is rotated, and the rotational force is transmitted to shaft 176 through one-way clutch 174, thereby rotating shaft 176 in a direction of the solid line of FIG. 14. Pulleys 182 are rotated together with shaft 176, so that belts 188 run in the manner as described above.

Driving belts 188 in guide device 172 are driven in synchronism with feeding of film sheet 52 from supply roll 68. Sheet 52 from roll 68 is guided by belts 188 and further fed. When the distal end of sheet 52 travels over the distal end of lifter 196 of device 172 and reaches reception portion 210, as shown in FIG. 14, part of adhesive tape 70 left at the distal end of sheet 52 is detected by sensor 212. At this time, motor 110 is stopped. Thereafter, when motor 110 is driven in the forward direction, roll 68 is rotated in a direction of the broken line in FIG. 15. In this case, the rotational force of motor 110 is not transmitted to shaft 176 due to the presence of one-way clutch 174. Therefore, only roll 68 is rotated in the direction of the broken line in FIG. 15, and then sheet 52 fed from roll 68 is taken up by roll 68. However, when the distal end of sheet 52 returns to the distal end of lifter 196, the distal end of sheet 52 is detected by sensor 208 (FIG. 8) arranged at the distal end of lifter 196. At this time, taking-up of sheet 52 is stopped. In other words, motor 110 is stopped.

Figure 15:
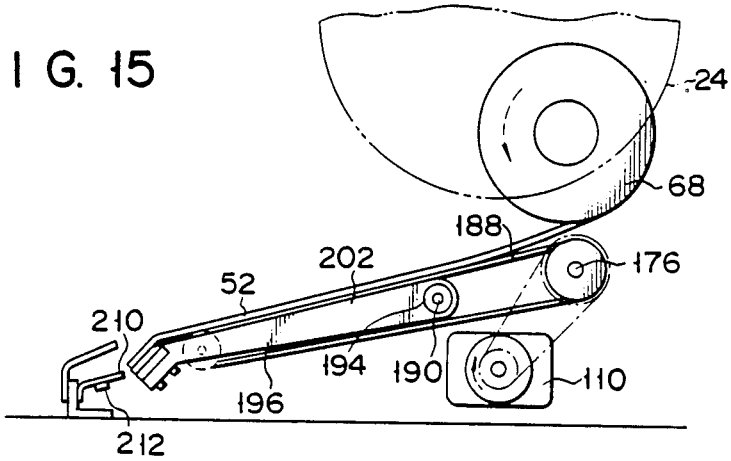

As shown in FIG. 15, when the distal end of sheet 52 fed from roll 68 comes close to the distal end of lifter 196, the distal end of sheet 52 is attracted to and held by suction portion 214 aranged at the distal end of lifter 196.

Figure 16:
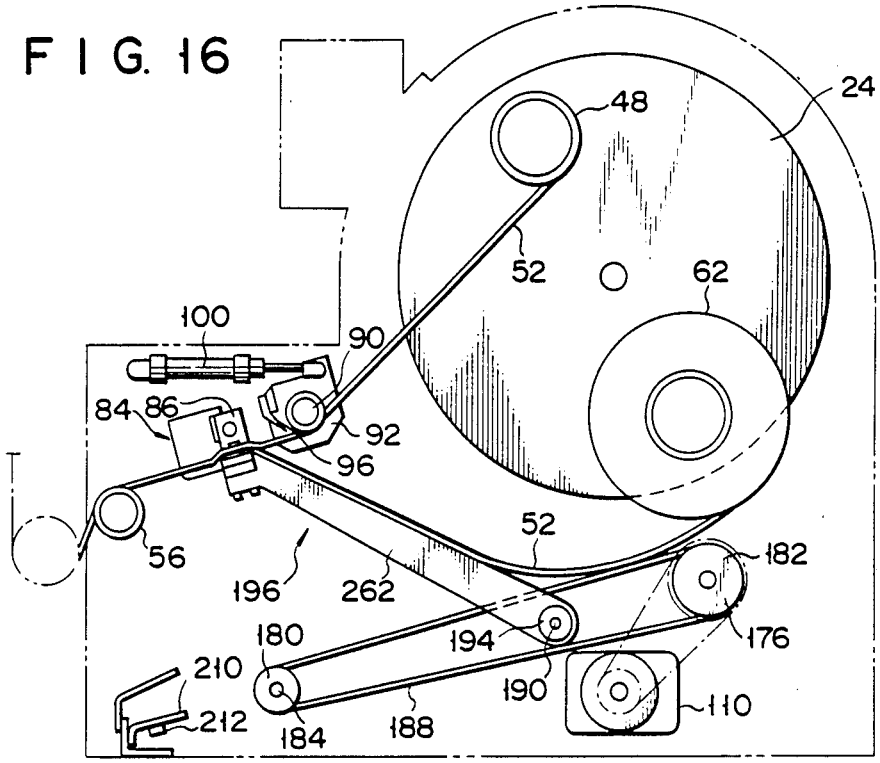

Thereafter, air cylinder 204 (FIG. 8) in guide device 172 is operated to pivot lifter 196 upward in FIG. 16. The distal end of lifter 196 is moved upward to the feed path of sheet 52 fed from roll 48. The distal end of sheet 52 fed from roll 68 overlaps sheet 52 fed from roll 48. These film sheets 52 from rolls 48 and 68 are urged against heater block 86 in heater device 84. At this time, heater block 86 has already been heated to a predetermined temperature. Sheets 52 are bonded by heat from block 86. At the same time, the distal end of sheet 52 which is attached to suction portion 214 is released therefrom. After sheets 52 are bonded together, the resultant sheet is fed to the following apparatus, i.e., a wrapping machine along the feed path.

However, when the piston rod of air cylinder 100 in cutter device 88 is withdrawn to rotate plate 92 counterclockwise in FIG. 16, sheet 52 fed from supply roll 48 is cut by cutter 96 mounted on plate 92. Therefore, after sheet 52 from roll 48 is cut, only sheet 52 from roll 68 is supplied to the wrapping machine. Therefore, sheet feeding is automatically switched from roll 48 to roll 68.

The movable members described above are returned to the original positions.

After sheet feeding is switched from roll 48 to roll 68, the piston rod of air cylinder 80 in stopper device 72 in FIG. 1 is withdrawn, and engagement between stopper arm 74 and ratchet 78 on disc 24 is released. Motor 28 is then driven to rotate disc 24 counterclockwise (FIG. 1) by half a revolution. Roll 68 comes near the current position of roll 48, and roll 48 also comes near the current position of roll 68. Thereafter, stopper device 72 is driven to engage stopper arm 74 with the other ratchet 82 on disc 24, so that rotation of disc 24 is stopped. In this case, the empty roll 48 is replaced with roll 68, and thus the state of FIG. 1 is obtained.

Figure 17:
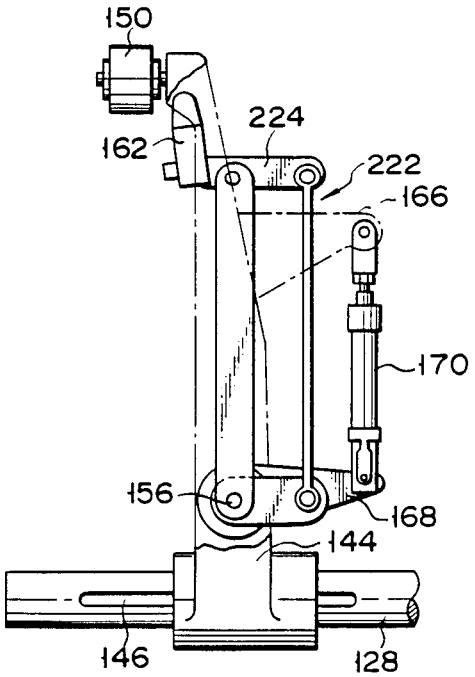
FIG. 17 is a side view showing another actuation mechanism for a knife arm in the apparatus of FIG. 1.

The present invention is not limited to the particular embodiment described above. As shown in FIG. 17, another actuation mechanism 220 is arranged to drive knife arm 160, i.e., knife 162. In the embodiment of FIG. 17, knife 162 is fixed on upper horizontal link lever 224 constituting parallel crank mechanism 222. With this arrangement, operation of air cylinder 170 allows movement of knife 162 to be parallel to the axial direction of supply roll 68 so as to accurately and properly cut adhesive tape 70 even if parallel crank mechanism 222 is pivoted about rod 156.

What is claimed is:

1. An apparatus for continuously supplying sheets from supply rolls, comprising:

a rotary disc vertically disposed such that a central axis thereof extends in a horizontal direction, the rotary disc being rotatable about the central axis;

a first supply roll mounted at a peripheral portion of the rotary disc and including a roll of sheet material, the first supply roll having a first axis parallel to the central axis of the rotary disc, the first supply roll being rotatable about the first axis;

means for feeding the sheet from the first supply roll, the feeding means having a sheet feeding path;

a second supply roll mounted at a peripheral portion of the rotary disc and including a roll of sheet material, the second supply roll having a second axis parallel to the central axis of the rotary disc and being rotatable about the second axis, the second supply roll being provided with an adhesive tape for partially fixing a distal end of the sheet to an outer surface of the second supply roll;

a cutting/feeding device, located near the rotary disc, for cutting the adhesive tape of the second supply roll and feeding the sheet therefrom, the cutting/feeding device including driving means for reversibly rotating the second supply roll, knife means provided with a knife to come into contact with or to be separated from an outer surface of the second supply roll, and actuating means for moving the knife along a direction parallel to the second axis of the second supply roll when the knife of the knife means is inserted under the distal end of the sheet of the second supply roll, the knife being adapted to be inserted under a portion excluding a region of the distal end of the sheet of the second supply roll upon driving of the second supply roll by the driving means, the region being fixed to the outer surface of the second supply roll by means of the adhesive tape, whereby the adhesive tape of the second supply roll is cut upon cooperation of the knife and the actuating means and, thereafter, the sheet of the second supply roll is fed therefrom upon rotation of the second supply roll by the driving means;

guiding means for guiding the sheet fed from the second supply roll and hence the distal end thereof to a predetermined connection position in the feed path of the feeding means;

adhering means for adhering the sheet from the first supply roll to the distal end of the sheet from the second supply roll at the connection position; and cutting means, disposed in the feed path between the connection position and the first supply roll, for cutting the sheet fed from the first supply roll.

2. An apparatus according to claim 1, wherein the knife means in the cutting/feeding device further includes a rotating shaft parallel to the second axis of the second supply roll and a knife arm coupled to the rotatable shaft so as to be pivotable upon rotation of the rotating shaft, the knife arm being provided with the knife.

3. An apparatus according to claim 2, wherein the knife comprises a thin plate member having elasticity.

4. An apparatus according to claim 3, wherein the knife means further includes a pivot arm, a proximal end of which is mounted on the rotatable shaft and a distal end of which is provided with a roller to be brought into rolling contact with the second supply roll simultaneously when the knife is brought into contact with the second supply roll, the roller being located opposite the knife along a direction of movement of the knife by the actuating means.

5. An apparatus according to claim 1, wherein the guiding means includes a conveyor located below the second supply roll to convey the film sheet fed from the second supply roll and lift means for lifting the film sheet fed from the second supply roll while the distal end of the film sheet from the second supply roll is held.

6. An apparatus according to claim 5, wherein the lift means comprises a pivot arm, one end of which is rotatably supported and the other end of which is provided with film sheet holding means.

* * * * *

UNITED STATES PATENT AND TRADEMARK OFFICE

CERTIFICATE OF CORRECTION

PATENT NO. : 4,695,007

DATED : September 22, 1987

INVENTOR(S) : Yoshiyuko Muto, Tadeo Etani, Satoru Aida, and Shinya Kato

It is certified that error appears in the above-identified patent and that said Letters Patent is hereby corrected as shown below:

Title page: §73 Assignees, change "Manimakanbara" to -- Minamikanbara-Gun --.

Signed and Sealed this

Seventeenth Day of May, 1988

*Attest:*

*Attesting Officer*

DONALD J. QUIGG

*Commissioner of Patents and Trademarks*